US007326883B2

(12) United States Patent
Bertani

(10) Patent No.: US 7,326,883 B2
(45) Date of Patent: Feb. 5, 2008

(54) LOW NOISE FAN HEATER

(75) Inventor: Carlo Bertani, Montecchio E. (IT)

(73) Assignee: Chung Mei Industries Limited, Kwun Tong, Kowloon (HK)

( * ) Notice: Subject to any disclaimer, the term of this patent is extended or adjusted under 35 U.S.C. 154(b) by 68 days.

(21) Appl. No.: 11/368,555

(22) Filed: Mar. 6, 2006

(65) Prior Publication Data

US 2006/0219695 A1 Oct. 5, 2006

(30) Foreign Application Priority Data

Mar. 16, 2005 (GB) ..... 0505280.8

(51) Int. Cl.
*A21B 1/22* (2006.01)
*F24D 15/02* (2006.01)

(52) U.S. Cl. ..... 219/400; 392/367; 392/385; 392/491; 392/360; D23/328; D23/335; D23/340

(58) Field of Classification Search ..... 392/367–385, 392/491, 360–61; D23/328, 335, 340; 219/400
See application file for complete search history.

(56) References Cited

U.S. PATENT DOCUMENTS 4,642,441 A * 2/1987 Kenyon ..... 392/365
5,761,377 A * 6/1998 Wolfe et al. ..... 392/376

* cited by examiner

*Primary Examiner*—Shawntina Fuqua
(74) *Attorney, Agent, or Firm*—The Maxham Firm

(57) ABSTRACT

A housing and a base formed integrally with the housing or attached thereto. An array of louvres is attached to or formed integrally with the housing. An electric motor-driven fan is located within the housing and blows air toward the louvres. An electric heating element is situated within the housing between the fan and the array of louvres. This avoids subjecting the fan to excessive heat of the heating element and reduces turbulence of airflow past the louvres, thereby reducing operational noise levels.

8 Claims, 2 Drawing Sheets

LOW NOISE FAN HEATER

BACKGROUND OF THE INVENTION

The present invention relates to electric fan heaters. More particularly, although not exclusively, the invention relates to an electric fan heater having its fan blade located behind its heating elements and comprising smooth profiled louvres which provide a broadening air flow path to reduce operational sound levels.

Known electric fan heaters comprise one or more electric heating elements situated behind the fan. That is, the air is preheated prior to its interaction with the fan. The fan then draws preheated/low-density air through the heating elements and blows the heated air through simple safety louvres at the front. There are several problems associated with such fan heaters. Firstly, the fan blade and electric fan motor are subject to air-contact with air that is already heated by the heating element(s) and must therefore be designed to withstand such temperatures. Secondly, as the fan is acting on low-density/expanded hot air, it must operate at a speed higher than that at which it would have to operate at room temperature to drive the same volumetric flow rate of air. It creates unnecessary fan/motor noise. Thirdly, the close proximity of the fan to the safety louvres at the front of the heater body causes turbulent airflow through the louvres—which turbulence interacts with the louvres to create high operational noise levels.

SUMMARY OF THE INVENTION

It is an object of the present invention to overcome or substantially ameliorate at least one of the above disadvantages and/or more generally to provide an improved electric fan heater.

There is disclosed herein an electric fan heater comprising:

a housing, a base formed integrally with the housing or attached thereto and comprising a support surface by which the base can be supported upon a fixed surface so as to maintain the housing in a use position, a grille attached to or formed integrally with the housing, an electric motor-driven fan located within the housing and operational to direct a flow of air toward the grille, and an electric heating element situated within the housing between the fan and the grille.

Preferably, the grille comprises an array of louvres

Preferably, the louvres are of smooth profile, comprising a wide portion and an exit portion that narrows in a direction away from the heating element.

Preferably, there is a space defined between each louvre that widens between respective said exit portions of the louvres in a direction away from the heating element.

Preferably, each louvre comprises an entry portion that is shorter than the exit portion and narrows from the wide portion toward the heating element.

Preferably the fan heater further comprises a separately manufactured heat-resistant cowling within which the electric motor-driven fan and a heating element are supported, the cowling being located within the housing and protecting the housing from heat emanating from the heating element.

Preferably, the louvres are formed upon a separate plate attached to the housing.

BRIEF DESCRIPTION OF THE DRAWINGS

A preferred form of the present invention will now be described by way of example with reference to the accompanying drawings, wherein.

DETAILED DESCRIPTION OF THE INVENTION

Figure 1:
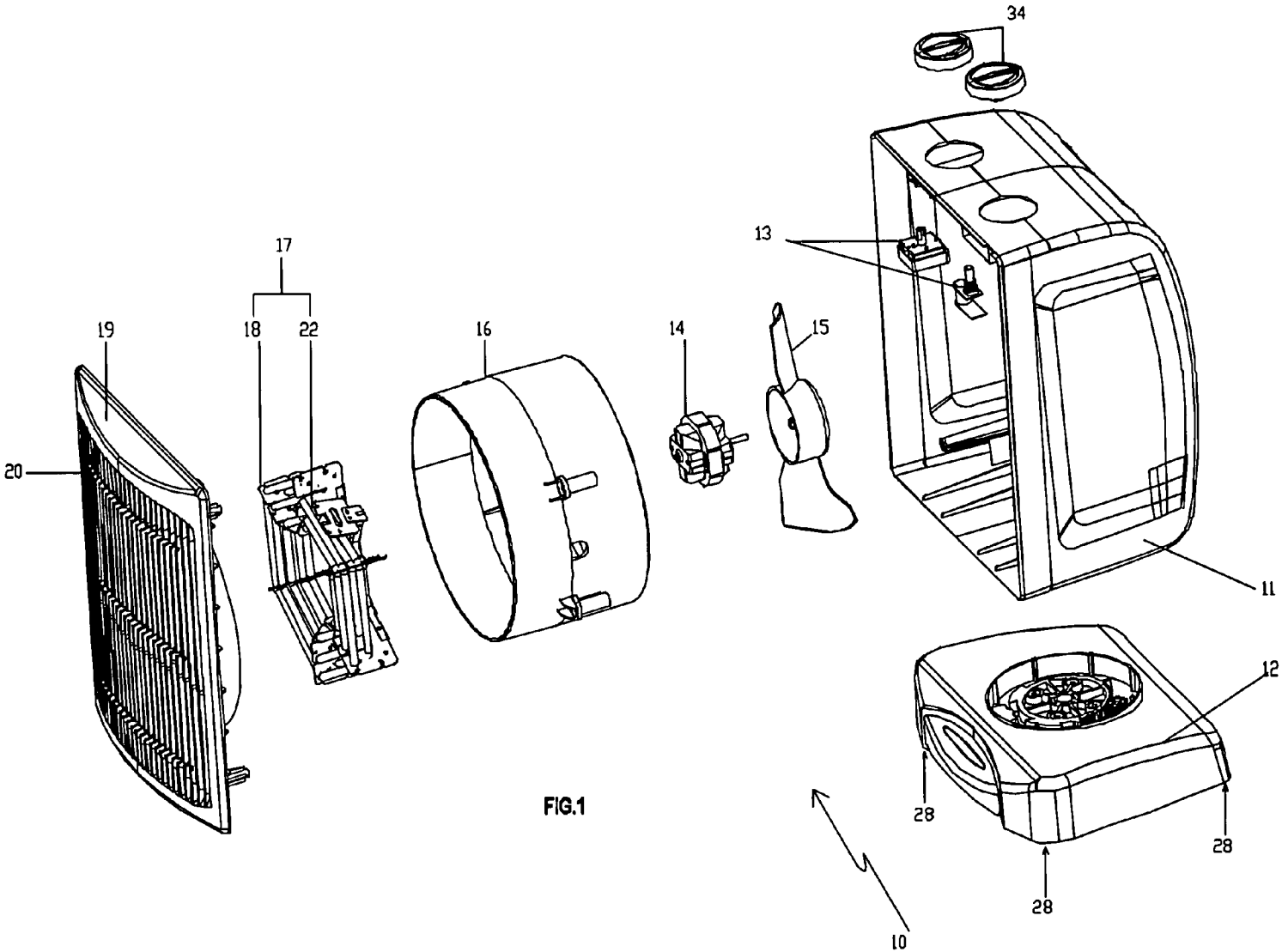
FIG. 1 is a schematic parts-exploded perspective illustration of an electric fan heater.

In the accompanying drawings there is depicted schematically an electric fan heater 10 comprising a housing 11 that sits upon a base 12. The base 12 includes a number of support surfaces 28 that reside in a common plan and by which the base sits upon a flat surface such as a floor surface. The housing 11 and base 12 would typically be formed of moulded plastics material. There are control switches 13 located within the housing and connected to control knobs or dials 34 provided at the top of the housing 11. Mounted within the housing is an electric motor 14 which drives a fan blade 15. The fan blade 15 is located near the back of the housing 11. A cowling 16 houses an array of heating elements 17 comprising electrical resistance wires 22 supported upon a mica former 18. The cowling 16 might be made of metal or high-temperature/fire-resistant plastics material. For manufacturing purposes, the cowling 16 is designed as a modular component that can be pre-assembled and stocked in the warehouse until required for insertion into a variety of different shaped housings as demand dictates. Attached to the front of the housing 11 is a louvre plate 19 having integrally formed plastics louvres 20. A safety grid 21 is attached at the back of the housing adjacent to the fan blades 15.

Figure 3:
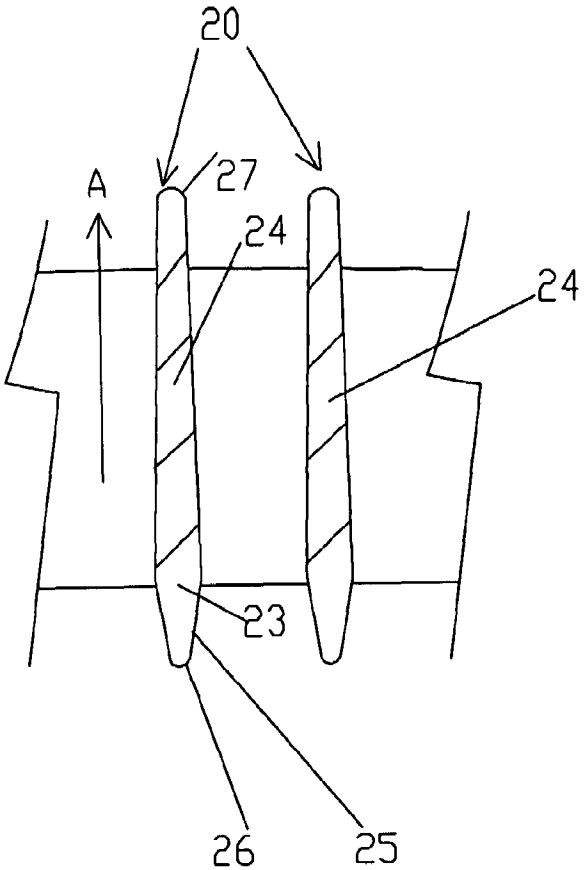
FIG. 3 is a schematic detailed depiction of a pair of louvres in an array of louvres of the fan heater.
Figure 2:
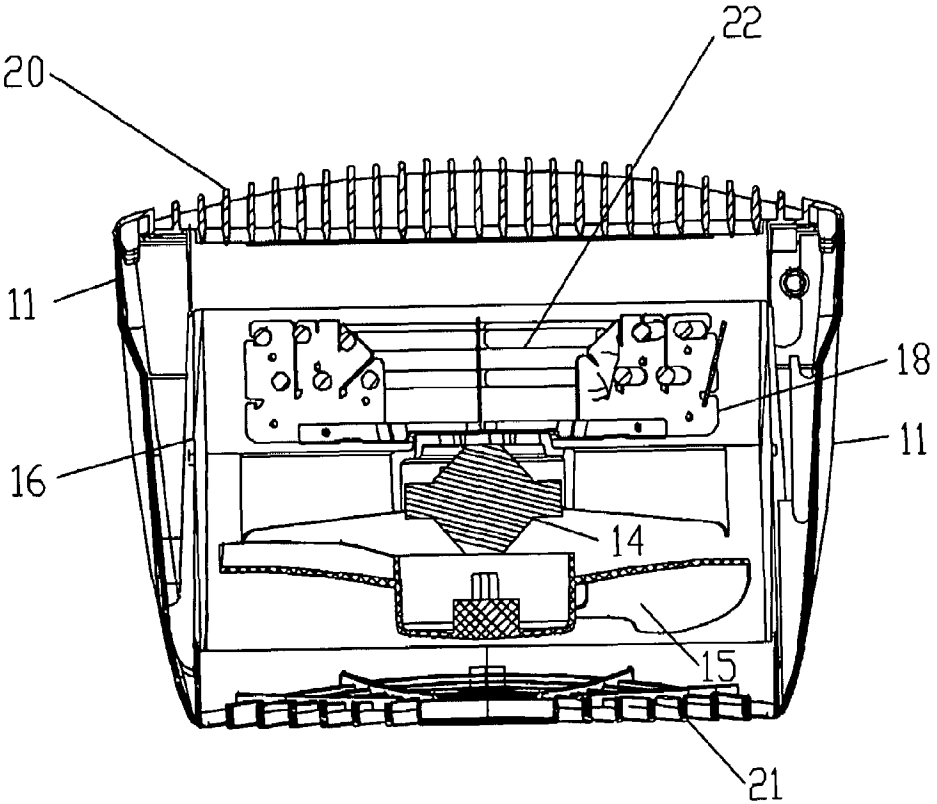
FIG. 2 is a schematic cross-sectional plan of the assembled fan heater.

Each louvre 20 comprises a wide portion 23 and exit portion 24 and an entry portion 25. The exit portion 24 narrows in an airflow direction (away from the fan and heating element) as indicated by arrow A in FIG. 3 and is significantly longer than the entry portion 25 which narrows from the wide portion 23 toward the heating element 17.

Each louvre is of smooth profiled shape including a rounded entry tip 26 and a rounded exit tip 27. In between the respective exit portions 24 of adjacent louvres 20, the air flow path widens. This has an effect on the airflow therepast. Moreover, the air decelerates slightly toward the exit tip 27 as a result of the slight widening of the flow path. This reduces turbulence en route toward exiting the fan heater—resulting in a more laminar and therefore quieter airflow as the air exits past the exit tip 27.

In use, the motor 14 and heating elements are activated upon manipulation of the dials 34 and the fan blade 15 draws cool air in through the safety grid 21. The interaction of the fan blade 15 with the cool air efficiently creates a good volumetric flow rate of air delivered to the heating elements. This also results in longer fan motor life as the motor is not subjected to the heat of the heating elements. As the air passes the heating elements, it heats and expands and therefore accelerates before exiting past the louvres.

It should be appreciated that modifications and alterations obvious to those skilled in the art are not to be considered as beyond the scope of the present invention. For example, the louvres might be pivot-mounted in order to selectively direct a flow of heated air.

What is claimed is:

1. An electric fan heater, comprising:

a housing, a base formed integrally with the housing or attached thereto and comprising a support surface by which the base can be supported upon a fixed surface so as to maintain the housing in a use position, a grille attached to or formed integrally with the housing, an electric motor-driven fan located within the housing and operational to direct a flow of air toward the grille, and an electric heating element situated within the housing between the fan and the grille, wherein the grille comprises an array of louvres, and wherein the louvres are of smooth profile, comprising a wide portion and an exit portion that narrows in a direction away from the heating element.

2. The fan heater of claim 1, wherein there is a space defined between each louvre that widens between respective said exit portions of the louvres in a direction away from the heating element.

3. The fan heater of claim 1, wherein each louvre comprises an entry portion that is shorter than the exit portion and narrows from the wide portion toward the heating element.

4. The fan heater of claim 1, further comprising a separately manufactured heat-resistant cowling within which the electric motor-driven fan and a heating element are supported, the cowling being located within the housing and protecting the housing from heat emanating from the heating element.

5. The fan heater of claim 1, wherein the louvres are formed upon a separate plate attached to the housing.

6. The fan heater of claim 1, wherein the louvres are formed upon a separate plate attached to the housing.

7. The fan heater of claim 2, wherein the louvres are formed upon a separate plate attached to the housing.

8. The fan heater of claim 3, wherein the louvres are formed upon a separate plate attached to the housing.

* * * * *